US005319907A

United States Patent [19]

Nicholas et al.

[11] Patent Number: 5,319,907

[45] Date of Patent: Jun. 14, 1994

[54] TELESCOPING WALL JOINT SYSTEM, ESPECIALLY FOR SEISMIC APPLICATIONS

[75] Inventors: John D. Nicholas, Lawrenceville; David W. Rice, Decatur, both of Ga.

[73] Assignee: Pawling Corporation, Pawling, N.Y.

[21] Appl. No.: 912,498

[22] Filed: Jul. 13, 1992

[51] Int. Cl.[5] ..... E04B 1/68

[52] U.S. Cl. ..... 52/396.05

[58] Field of Search ..... 52/395, 396, 573, 583; 404/47

[56] References Cited

U.S. PATENT DOCUMENTS

| | | | |
|---|---|---|---|
| 3,371,456 | 3/1968 | Balzer et al. | 52/396 |
| 3,390,501 | 7/1968 | Driggers | 52/396 |
| 3,417,528 | 12/1968 | Hallock | 52/396 |
| 4,271,650 | 1/1981 | Lynn-Jones | 52/395 |
| 4,914,884 | 4/1990 | Ohmatsu | 52/573 |
| 4,956,955 | 9/1990 | Ohmatsu | 52/573 |

FOREIGN PATENT DOCUMENTS

| | | | |
|---|---|---|---|
| 2314667 | 10/1974 | Fed. Rep. of Germany | 52/573 |
| 2418248 | 11/1974 | Fed. Rep. of Germany | 52/396 |
| 2315581 | 1/1977 | France | 52/573 |

*Primary Examiner*—James L. Ridgill, Jr.

*Attorney, Agent, or Firm*—Schweitzer Cornman & Gross

[57] ABSTRACT

A telescoping wall joint system is disclosed, for connecting adjacent sections of an architectural structure, while accommodating substantial relative movement, such as might result from seismic activity Extended motion is provided in the joint system while avoiding the use of excessively wide components, which are both costly and aesthetically undesirable. A center cover plate, which spans the open space between two adjacent structural units, is received along one or both sides in a tubular sleeve. The cover plate is slidably extendable within a predetermined range in the tubular sleeves to accommodate normal movements of the structural units, such as may result from thermal expansion and contraction, for example. The tubular sleeves themselves are slidably received within fixed housings mounted on the respective structural units. When the separating movement of two adjacent structural units becomes so great that the cover plate reaches a limit condition in its slidable extension out of the tubular sleeves, the sleeves themselves slidably extend in relation to the housings in which they are carried. The capacity of the system to accommodate separating movement of the structures is thus greatly increased.

14 Claims, 2 Drawing Sheets

TELESCOPING WALL JOINT SYSTEM, ESPECIALLY FOR SEISMIC APPLICATIONS

BACKGROUND AND SUMMARY OF THE INVENTION

In the design and construction of architectural structures, it is a common practice to provide for segmented construction, with a space being provided between adjacent structural units, which may be relatively movable with respect to each other as a result of normal expansion and contraction, and in some cases as a result of seismic activity. It is typical, in such structural arrangements, to provide a suitable cover means for spanning the gap between the adjacent structures. Such cover arrangements typically may include a cover plate which extends across the gap between the adjacent structures and is movably received with respect to one or both of the structures, frequently in a recess or chamber provided therein. In many cases, facilities are provided for maintaining the cover plate in a centered or symmetrical relation to both of the adjacent architectural units.

In one well known form of expansion joint system of the general type described above, a generally flat cover plate extends across the space between two adjacent structural units and projects slidably into a cavity in at least one of them. As the two structures are caused to move toward and away from each other, the cover plates slides into and out of a recess provided to receive it. Examples of known designs of such joint systems are reflected in the Balzer et al. U.S. Pat. No. 3,371,456 and the Hallock U.S. Pat. No. 3,417,528, for example.

Where the movement to be accommodated by the expansion joint system is purely a function of normal expansion and contraction, a conventional joint system of suitable proportion can provide adequate performance. Where occasional seismic activity must be accommodated, however, the joint must be designed for significantly greater than normal motion on at least an occasional basis. To accommodate such exceptional occasional motion with joint systems of conventional design requires joint systems that are undesirably large in relation to the normal separation between the adjacent structural units. This is not only costly but, perhaps equally important, tends to be aesthetically unattractive.

In accordance with the present invention, a novel and improved architectural joint system is provided which incorporates multiple stages of expansion, by reason of a telescopic construction. During normal expansion and contraction activities, the new joint system has the appearance and function of systems of more conventional design. However, when, due to seismic activity or other reasons, the normal separation of the structures is exceeded, the joint system of the invention is capable of expanding accordingly, through a second stage expansion feature. The new joint system thus accommodates a substantially greater degree of separation between the structural units, without at the same time requiring the components of the joint system to be undesirably wide. The joint system of the invention is especially well suited for use in walls and ceilings, while not being limited thereto.

In a preferred form of the invention, an otherwise conventional sliding cover plate is received within normally stationary but telescopically movable sleeves, which are in turn slidably received within chambers defined by the stationary structure of the expansion joint system. During normal expansion and contraction, the cover plate slides with respect to the telescoping sleeves to accommodate normal motion. When the separation of the structural unit exceeds the width of the cover plate, however, the telescoping sleeves themselves slide within the mounting structure, to greatly increase the ability of the structures to separate without destroying the expansion joint system.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
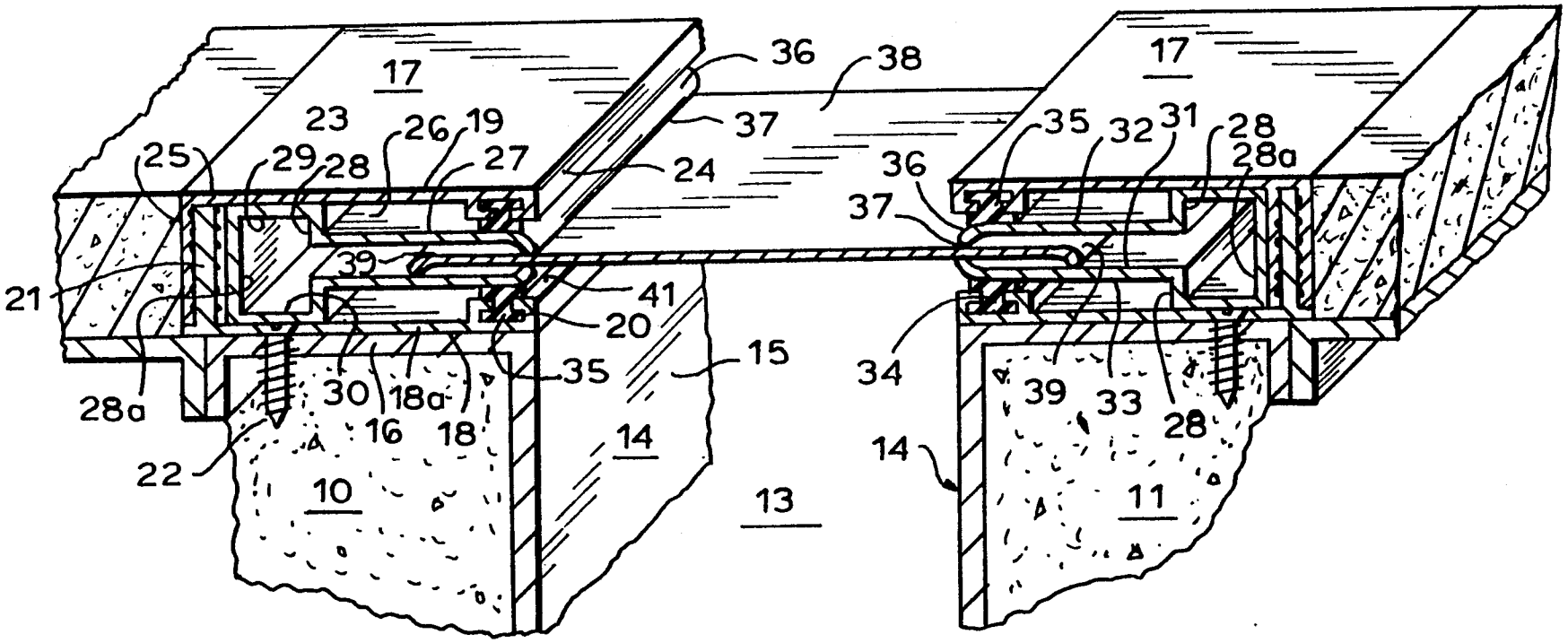
FIG. 1 is a fragmentary perspective view showing the telescoping expansion joint system of the invention in cross section.

Referring now to the drawing, and initially to FIG. 1 thereof, the reference numerals 10, 11 designate generally a pair of spaced-apart, independent architectural structures, such as wall or ceiling sections, for example. The structures are normally separated by a space 13, which may increase or decrease in size in the normal course, through expansion and contraction of the structure units, for example, or as a result of seismic activity. Each of the structures 10, 11 is provided with a facing member 14, typically a roll-formed steel stud with sidewalls 15 and outer walls 16 providing defined corner geometry.

In the illustrated structure, a housing assembly 17 is mounted on each of the structures 10, 11. Each housing is comprised of a base part 18 and a cover part 19. The base part includes a flat bottom plate **18*a* provided at one side with a channel-forming flange 20, and adjacent its opposite edge with an upwardly projecting flange 21 formed with serrated surfaces. The base parts 18 are adapted to be secured rigidly to the metal studs 14, by means of screws 22 or the like, desirably being located so that the outer face of the channel-forming structure 20 is substantially aligned with the sidewall 15 of the stud 14**.

The cover members 19 are formed with a flat cover plate 23 having an integral channel-forming flange 24 at its outer edge, similar to and arranged in opposing relation to the channel-forming flange 20 of the base member 18. At its opposite edge, the cover 19 is formed with integral, downwardly extending flanges 25, preferably serrated along their inner surfaces, arranged to be closely received over the upwardly projecting flange 21 of the base member. The arrangement is such that, when the base and cover parts 18, 19 are assembled together, they are tightly secured in assembled relation by the gripping action of the flanges 25 on the upwardly projecting flange 21.

As shown in the drawing, the assembled base and cover parts 18, 19 define an internal chamber 26 arranged for the laterally slidable reception of a telescoping sleeve 27. The sleeve 27, like the base and cover members 18, 19, advantageously is a continuous extrusion of uniform cross section. The sleeve may be formed of aluminum, but for many installations may be formed of an engineering plastic. In the illustrated form, the sleeve includes an enlarged base portion comprising front and back abutment walls 28, 28*a* joined by upper and lower guide walls 29, 30. The guide walls are closely but slidably confined by the walls 18*a*, 23 of the base and cover members 18, 19 respectively. The telescoping slide 27 also includes an elongated, horizontally extending hollow tongue portion 31 defined by upper and lower walls 32, 33 respectively. The walls 32, 33 of the tongue portion are confined and guided by resilient sealing strips 34, 35 which are held in the channel-forming flanges 20, 24 in the respective base and cover members 18, 19 and define a lateral opening 41 which extends longitudinally along the space 13.

At their outer end extremities, the tongue walls 32, 33 are convergently curved, as indicated at 36, defining a narrow slot 37 arranged for the close confinement and slidable reception of a generally flat cover plate 38. The cover plate 38 is of uniform cross section throughout its length, and can be either an extrusion or a formed metal strip. In either case, the cover plate is provided with retaining flanges 39 at each end.

As shown particularly in FIG. 1, in the normal configuration of the structure of the invention, the telescoping sleeves 27 are fully retracted within the chambers 26, with the back abutment walls 28*a* stopped against the cover flange 25. In that position only the end extremities of the tongue portions 27 project through the elongated slots defined by the upper and lower sealing strips 34, 35. The cover plate 38 has an overall width which is substantially greater than the "normal" width of the open space 13 between the two structures 10, 11, such that the retaining flanges 39 of the cover plate normally are located a substantial distance inward from the slot openings 37 formed at the end extremities of the tongue portions 31. With this nominal geometry, the structures 10, 11 may undergo normal movements toward and away from each other, within design limits. As long as the normal limits are not exceeded, the movements are accommodated by the cover plate 38 sliding with respect to the telescoping sleeves 27, and with the latter remaining stationary. To this end, suitable provision is made to assure that the friction between the telescoping sleeves 27 and the housings 17 is greater than the friction between the cover plate 38 and the telescoping sleeves, where the two are in contact.

Figure 2:
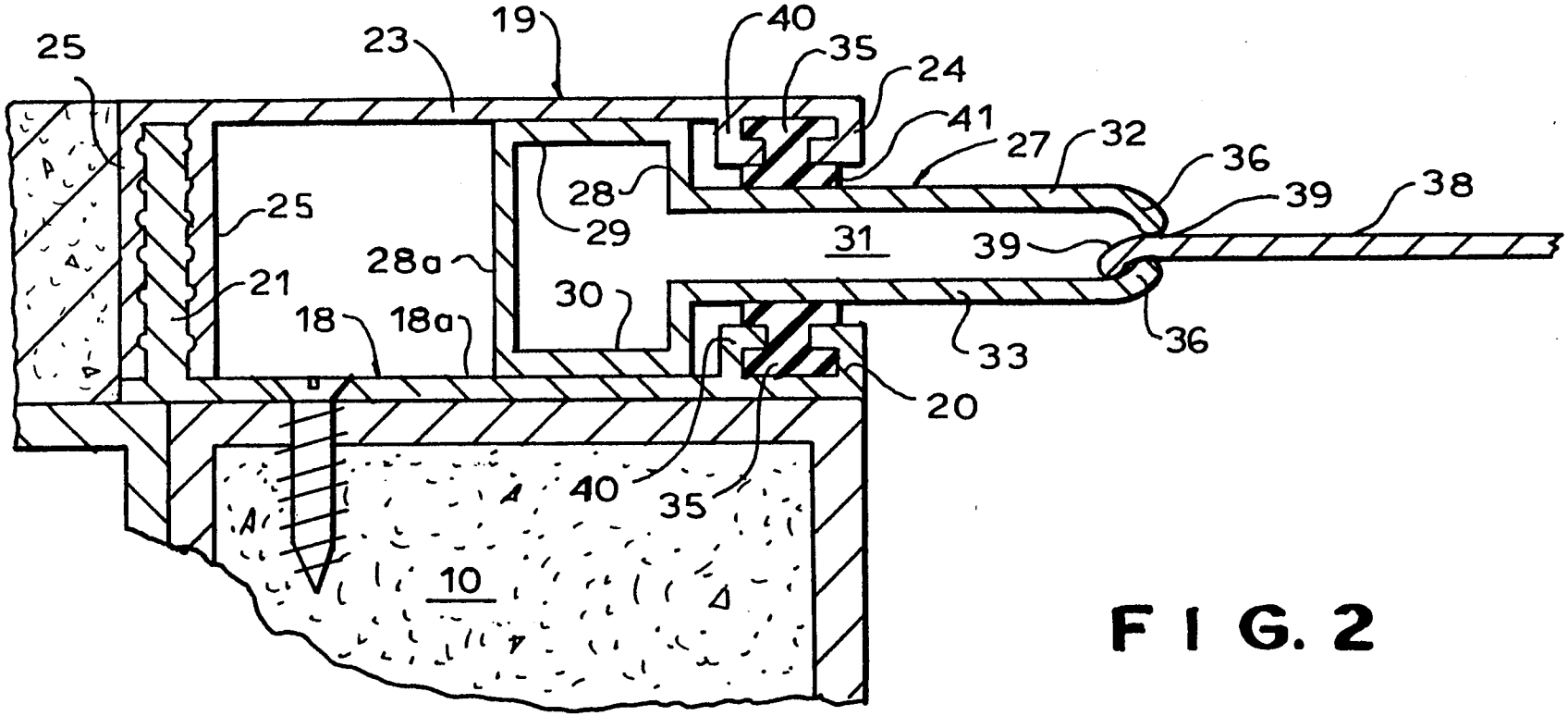
FIG. 2 is an enlarged, fragmentary cross sectional illustration of the joint of FIG. 1, showing the joint in an extended configuration.

In the case of an extraordinary degree of separation of the structures 10, 11, the retaining flanges 39 of the cover plate can eventually reach and engage the convergent end flanges 36 of the telescoping sleeves 27. Continued separation of the structures 10, 11 will then cause one or both of the telescoping sleeves 27 to be displaced outwardly, causing the tongue portions 31 thereof to be extended, in the manner indicated in FIG. 2. Thus, during an extraordinary condition, such as a seismic disturbance, the normal limits of separation of the structures 10, can be greatly exceeded without irreparably damaging the expansion joint system.

If the separation of the structures 10, 11 become such that the front abutment walls 28 of the tubular sleeves come into contact with walls 40 of the channel-forming flanges 20, 24, the telescoping sleeves reach a limit position beyond which further expansion is not possible.

The telescoping joint system of the invention accommodates significantly greater amounts of structural separation than conventional joint systems, without requiring that the main housing structure, comprised of the base and cover members 18, 19, be of greater width than conventional systems. For normal expanding and contracting movements of the adjacent structures, the operation of the telescoping joint system is substantially the same as conventional systems. Only when, by reason of seismic disturbance or other special conditions, the separation of the structures exceeds the "normal", do the telescoping sleeve elements become displaced from their normal, fully retracted positions. After cessation of the abnormal conditions, if the tubular sleeves have been displaced from their normal, fully retracted positions as shown in FIG. 1, they can be manually restored to such positions.

One of the important practical advantages of the invention is that the joint system accommodates a greater degree of motion of the architectural structures without significantly increasing the overall width of the elements. This is aesthetically important, because architects are reluctant to specify a system presenting an excessively wide sight line. The structure of the invention enables the sight line to be significantly decreased in relation to the motion capacity of the joint. Moreover, while the structure of the invention utilizes more components than conventional structures, it can be more economical in many cases, because the components are smaller, and the internally housed telescoping sleeve can, in many cases be formed of plastic material.

It should be understood, of course, that the specific forms of the invention herein illustrated and described are intended to be representative only, as certain changes may be made therein without departing from the clear teachings of the disclosure. By way of example only, while the invention has been illustrated as employing a slidable telescopic assembly at both sides of a joint, it may be desirable to provide such at only one side, as at a corner joint. Accordingly, reference should be made to the following appended claims in determining the full scope of the invention.

We claim:

1. A telescoping architectural joint system which comprises:

(a) first and second architectural units arranged in adjacent, generally aligned relation and being separated by a space, (b) opposed housings on the respective units, each forming an open-sided hollow enclosure adjacent said space and extending longitudinally along said space, (c) each of said hollow enclosures defining a lateral opening extending longitudinally along said space and facing a corresponding lateral opening of the opposed housing, (d) a telescoping slide element laterally slidably received in each of said enclosures and having a tongue portion extendable through said lateral opening, (e) said telescoping slide elements being normally retracted substantially within said hollow enclosures, (f) a cover plate laterally slidably received in each of said telescoping slide elements and spanning the space between said architectural units, (g) said cover plate being of a width to be normally at least partially received at each side within said hollow enclosures and being slideable relative to said telescoping slide elements during normal movements of said architectural units, and (h) interengaging elements on said cover plate and said telescoping slide elements for laterally displacing said slide elements outward from their normally retracted positions within said hollow enclosures only when said architectural units are separated beyond predetermined normal limits.

2. A telescoping joint system according to claim 1, further characterized by (a) said housings each comprising a base member and a cover member secured together and forming a hollow enclosure for receiving said telescoping slide element, (b) at least one of said base and cover members having a flange adjacent its outer edge projecting toward the other member and forming said lateral opening, (c) a sealing element mounted on said flange and slidably engaging the tongue portion of said telescoping slide element.

3. A telescoping joint system according to claim 1, further characterized by (a) said telescoping slide element comprising a base portion, including spaced front and back abutment walls and upper and lower guide walls, and said tongue portion, (b) said upper and lower guide walls being slidably guided within said housings, (c) said tongue portion extending from said front abutment walls and being exposed in said lateral opening when said telescoping slide element is in its normal fully retracted within said housings.

4. A telescoping joint system according to claim 3, further characterized by (a) said housings including flanges defining and partially restricting said lateral opening, (b) said front abutment walls being engageable with said flanges when said telescoping slide element is in an extended position.

5. A telescoping joint system according to claim 1, further characterized by (a) said housings each comprising a base member and a cover member, forming a space between them, and at least one flange defining and restricting said lateral openings, (b) said telescoping slide element comprising a hollow sleeve including a hollow tongue portion having a longitudinally extending restricted slot-like opening facing said space, (c) said cover plate having opposed edge margins extending through said slot-like openings and received within said hollow tongue portions.

6. A telescoping joint system according to claim 5, further characterized by (a) said hollow sleeve including first abutment elements adapted for cooperation with said flange to limit movement of said sleeve in an extending direction toward said space.

7. A telescoping joint system according to claim 5, further characterized by (a) said hollow sleeve including second abutment elements for limiting movement of said sleeve in a retracting direction away from said space.

8. A telescoping architectural joint system which comprises (a) first and second architectural units arranged in adjacent relation and separated by a space, (b) a housing on at least one of said architectural units forming a hollow enclosure adjacent said space and extending longitudinally along said space, (c) said enclosure defining a lateral opening extending longitudinally along said space and facing an opposing architectural unit, (d) a telescoping slide element laterally slidably received in said enclosure and having a tongue portion extendable through said lateral opening, (e) said telescoping slide elements being normally retracted substantially within said hollow enclosure, (f) a cover plate laterally slidably received in said telescoping slide element and spanning the space between said architectural unit, (g) said cover plate being of a width to be normally at least partially received in said hollow enclosure and being slideable relative to said telescoping slide element during normal movements of said architectural units, and (h) cooperative elements on said cover plate and said telescoping slide element for laterally displacing said telescoping slide element outward from its normally retracted position within said housing only when said architectural units are separated beyond predetermined normal limits.

9. A telescoping joint system according to claim 8, further characterized by (a) a second telescoping slide element being laterally slidably received in said opposing architectural unit, (b) said cover plate being laterally slidably received in said second telescoping slide element during normal movements of said architectural units.

10. A telescoping joint system according to claim 8, further characterized by (a) said housing comprising a base member and a cover member secured together and forming a hollow enclosure for receiving said telescoping slide element, (b) at least one of said base and cover members having a flange adjacent its outer edge projecting toward the other member and forming said lateral opening, (c) a sealing element mounted on said flange and slidably engaging said telescoping slide element.

11. A telescoping joint system according to claim 8, further characterized by (a) said telescoping slide element comprising a base portion, including spaced front and back abutment walls and upper and lower guide walls, and said tongue portion, (b) said upper and lower guide walls being slidably guided within said housing, (c) said tongue portion extending from said front abutment walls and being exposed in said lateral opening when said telescoping slide element is fully retracted within said housing and projected through said lateral opening when said telescoping slide element is displaced to an extended position.

12. A telescoping joint system according to claim 8, further characterized by (a) said housing comprising a base member and a cover member, forming a space between them, and at least one flange defining and restricting said lateral opening, (b) said telescoping slide element comprising a hollow sleeve including a hollow tongue portion having a longitudinally extending restricted slot-like opening facing said space, (c) said cover plate having an edge margin extending through said slot-like opening and receiving within said hollow tongue portion.

13. A telescoping joint system according to claim 12, further characterized by (a) said hollow sleeve including first abutment elements adapted for cooperation with said flange to limit movement of said sleeve in an extending direction toward said space.

14. A telescoping joint system according to claim 13, further characterized by (a) said hollow sleeve including second abutment elements for limiting movement of said sleeve in a retracting direction away from said space.

* * * * *